US005177492A

United States Patent [19]

Tomura et al.

[11] Patent Number: 5,177,492

[45] Date of Patent: Jan. 5, 1993

[54] ROD ANTENNA MOUNTING MECHANISM OF RADIO TERMINAL EQUIPMENT

[75] Inventors: Masahi Tomura; Hisamitsu Takagi, both of Kawasaki, Japan

[73] Assignee: Fujitsu Limited, Kawasaki, Japan

[21] Appl. No.: 764,719

[22] Filed: Sep. 24, 1991

[30] Foreign Application Priority Data

May 7, 1991 [JP] Japan ..... 3-130245

[51] Int. Cl.[5] ..... H01Q 1/24

[52] U.S. Cl. ..... 343/702; 343/900; 343/901

[58] Field of Search ..... 343/702, 900, 901, 906, 343/715

[56] References Cited

U.S. PATENT DOCUMENTS 4,523,197 6/1985 Imazeki et al. ..... 343/702
4,525,718 6/1985 Imazeki et al. ..... 343/702
4,760,401 7/1988 Imazeki ..... 343/702
4,860,024 8/1989 Egashira ..... 343/702
4,890,114 12/1989 Egashira ..... 343/702

FOREIGN PATENT DOCUMENTS 0301175 2/1989 European Pat. Off. ..... 343/702

*Primary Examiner*—Rolf Hille
*Assistant Examiner*—Hoanganh Le
*Attorney, Agent, or Firm*—Staas & Halsey

[57] ABSTRACT

A rod antenna mounting mechanism that allows easy and reliable connection of a rod antenna with a radio circuit arranged inside and easy replacement of itself. The rod antenna is installed by fixing a rod holder slidably attached to the rod antenna such that it can be pulled out, and stowed in, the casing. With the rod antenna mounted to the casing, an elastically deformable feeder plate connected to the radio circuit is pressed into contact with a conductive pipe-like portion of the rod holder, thus enabling electrical connection of the antenna element with the feeder plate.

3 Claims, 8 Drawing Sheets

ROD ANTENNA MOUNTING MECHANISM OF RADIO TERMINAL EQUIPMENT

BACKGROUND OF THE INVENTION

1. Field of the Invention

The present invention relates to a rod antenna mounting mechanism of a radio terminal equipment such as a portable telephone and a cordless telephone.

2. Description of the Prior Art

Mobile communication is gradually increasing in addition to conventional communications between stationary points. The mobile communication is adopted for communication between telephones on moving bodies such as ships, automobiles, aircraft, etc. and stationary telephones such as a general subscriber's telephone and an office telephone. In recent years, with the tendency described above, there have been extensively developed such mobile communications means as portable telephones and cordless telephones.

Radio terminal equipment, for example the aforesaid portable telephones and cordless telephones, are demanded to be made smaller in size, and accordingly it is also demanded to install a telescoping rod antenna. As the rod antenna mounting mechanism of prior art, the following mechanism has been widely known. That is, the rod antenna is secured at its fixing section by means of screws to a printed-circuit board of the radio terminal equipment. The printed-circuit board is also attached by screws to a casing of the radio terminal equipment. A radio circuit and a rod antenna in the casing are electrically connected through a conductor pattern formed on the printed-circuit board and a coaxial cable.

The prior-art rod antenna mounting mechanism described above, however, has the following problem that it requires a large mounting space because of the use of screws for securing the rod antenna, and therefore is not suitable for miniaturization of the equipment. In addition, the mounting mechanism is not easy to replace in the event of antenna trouble. Furthermore, since the rod antenna and the radio circuit inside the casing are connected through the printed-circuit board, the use of a coaxial cable will become necessary, resulting in a complicated structure of the mechanism.

SUMMARY OF THE INVENTION

It is, therefore, an object of the present invention to provide a rod antenna mounting mechanism of a radio terminal equipment which permits easy and firm connection with a radio circuit in the equipment and easy replacement of the rod antenna.

In accordance with an aspect of the present invention, there is provided a rod antenna mounting mechanism for mounting rod antenna to the casing of the radio terminal equipment. The rod antenna includes an extended small-diameter rod section and a first and a second large-diameter rod sections formed in connection with both ends of the small-diameter rod section, a cap formed at the end of the first large-diameter rod section, and a stopper formed at the end of the second large-diameter rod section. The rod antenna mounting mechanism includes rod holder means slidably mounted to the rod antenna for holding the rod antenna to the casing and having a pipe-like portion, an elastically deformable feeder plate connected to the radio circuit housed inside of the casing, and means for pressing the pipe-like portion of the rod holder means into contact with the feeder plate.

The pipe-like portion of the rod holder means is preferably provided with a longitudinal slit for permitting elastic expansion thereof. Accordingly, when the rod antenna is pushed into, or pulled out of, the casing and the first large-diameter rod section or the second large-diameter rod section contacts the inside surface of the pipe-like portion, the pipe-like portion elastically expands allowing the press-fitting of the first large-diameter rod section or the second large-diameter rod section into the pipe-like portion. Preferably an electrically neutral conductive member is installed in the casing, and is adapted such that the second large-diameter rod section contacts the electrically neutral conductive member when the rod antenna is housed in the casing.

The above and other objects, features and advantages of the present invention and the manner of realizing them will become more apparent, and the invention itself will best be understood from a study of the following description and appended claims with reference to the attached drawings showing some preferred embodiments of the invention.

DESCRIPTION OF THE PREFERRED EMBODIMENTS

Figure 1:
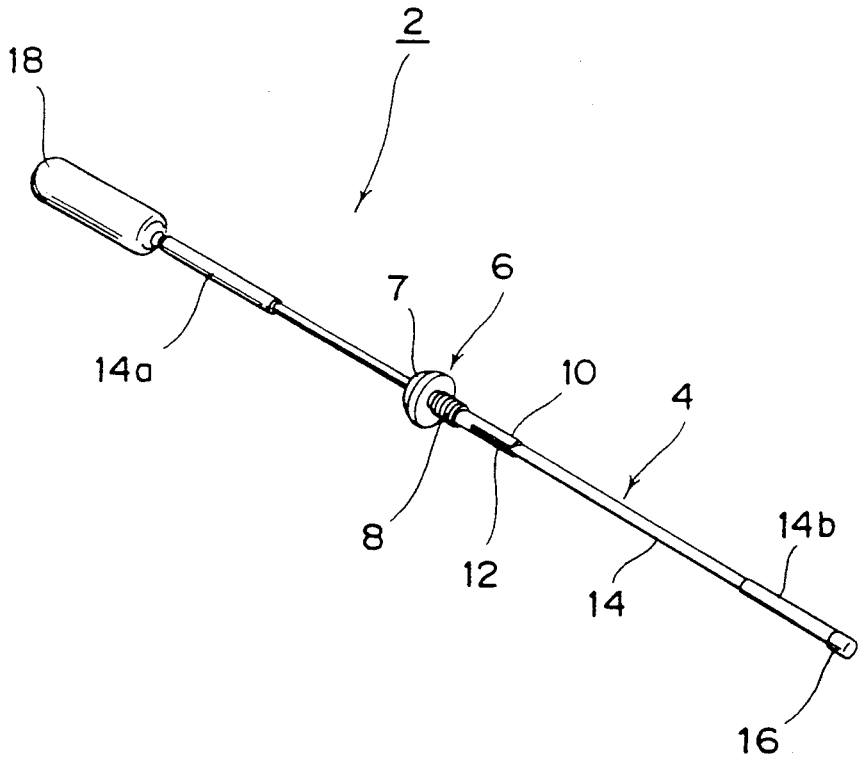
FIG. 1 is a perspective view of a embodiment of a rod antenna assembly according to the present invention.

Referring now to FIG. 1, a preferred embodiment of rod antenna assembly 2 according to the present invention includes an extended rod antenna 4 and a rod holder 6 slidably attached to the rod antenna 4 and holding the rod antenna 4 to a casing of a portable telephone. The rod holder 6 includes a large-diameter head 7, a fixing section 8 having screw threads, and an electrically conductive pipe-like portion 10 integrally formed with the fixing section 8. In the pipe-like portion 10 is formed at least one slit 12 (in this embodiment, two slits in opposite positions) in the longitudinal direction thereof, allowing the elastic deformation of the pipe-like portion 10.

The rod antenna 4 includes a small-diameter rod section 14 with the rod holder 6 slidably mounted, first and second large-diameter rod sections 14*a* and 14*b* formed in connection with both ends of the small-diameter rod section 14, a cap 18 formed in connection with the end part of the first large-diameter rod section 14*a*, and a stopper 16 formed in connection with the end part of the second large-diameter rod section 14*b*. The conductive antenna element extends into the small-diameter rod section 14, the first and second large-diameter rod sections 14*a* and 14*b* and the cap 18. Because the small-diameter rod section 14 requires no direct electrical connection, the antenna element of this section is covered with an insulating tube. The first and second large-diameter rod sections 14*a* and 14*b* and the stopper 16 are produced of a conductor, and the cap 18, of a synthetic resin with the antenna element inserted therein.

The first and second large-diameter rod sections 14*a* and 14*b* of the rod antenna 4 are formed slightly larger in diameter than the inside diameter of the pipe-like portion 10 of the rod holder 6. The small-diameter rod section 14 is formed smaller in diameter than the inside diameter of the pipe-like portion 10. According to this structure, the large-diameter rod sections 14*a* and 14*b* of the rod antenna 4 are pressed in and supported by the elastically expanded pipe-like portion 10 of the rod holder 6 because of the presence of the slit 12 when the rod antenna 4 is pushed into, or pulled out of the casing of the portable telephone. It is, therefore, possible to maintain the steady state of the rod antenna 4 which is pulled out of, or pushed into the casing. From this it has been verified that the rod antenna 4 can withstand 10,000 or more times of telescoping movement because of the adoption of the conductive pipe-like portion 10 of good wear resistance and the large-diameter rod sections 14*a* and 14*b* of good wear resistance.

Figure 2:
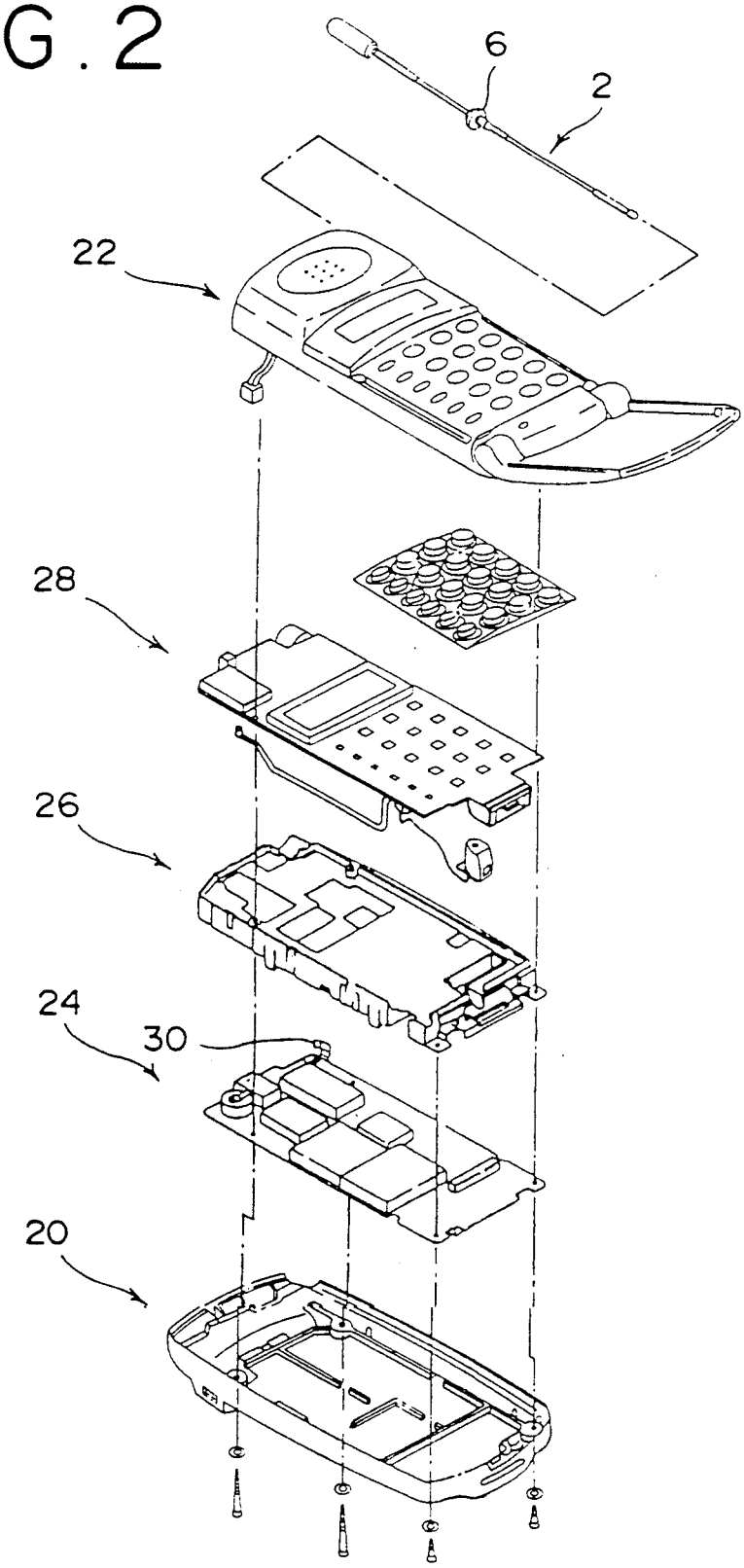
FIG. 2 is an exploded perspective view of a portable telephone with the rod antenna assembly shown in FIG. 1.

FIG. 2 is an exploded perspective view of a portable telephone mounted with the rod antenna assembly shown in FIG. 1. Reference numerals 20 and 22 refer to a rear casing and a front casing respectively, constituting a portable telephone casing assembled into one body by screws. In the casing are built a radio unit 24 mounted with high-frequency circuit parts and a control unit 28 mounted with a liquid crystal display and a dial switch.

Fastening the rod holder 6 by a screw to the insert pressed in the end of the front casing 22 attaches the rod antenna assembly 2 to the casing 22 such that it can be pulled out of and pushed in the casing. Reference numeral 30 denotes an elastically deformable feeder plate consisting of a conductor fixed by soldering to the printed-circuit board of the radio unit 24. This feeder plate 30 is pressed from the side into contact with the pipe-like portion 10 of the rod holder 6 attached to the casing, thereby electrically connecting the high-frequency circuit of the radio unit 24 with the antenna element of the rod antenna assembly 2. A circuit for impedance matching is built in the radio unit 24. The front end of the feeder plate 30 is bent in a direction in which it goes away from the rod antenna assembly 2. The bent section, therefore, will function to facilitate the installation of the rod antenna assembly 2 as well as to guide it without giving damage to the feeder plate 30 during replacement operation.

Figure 3:
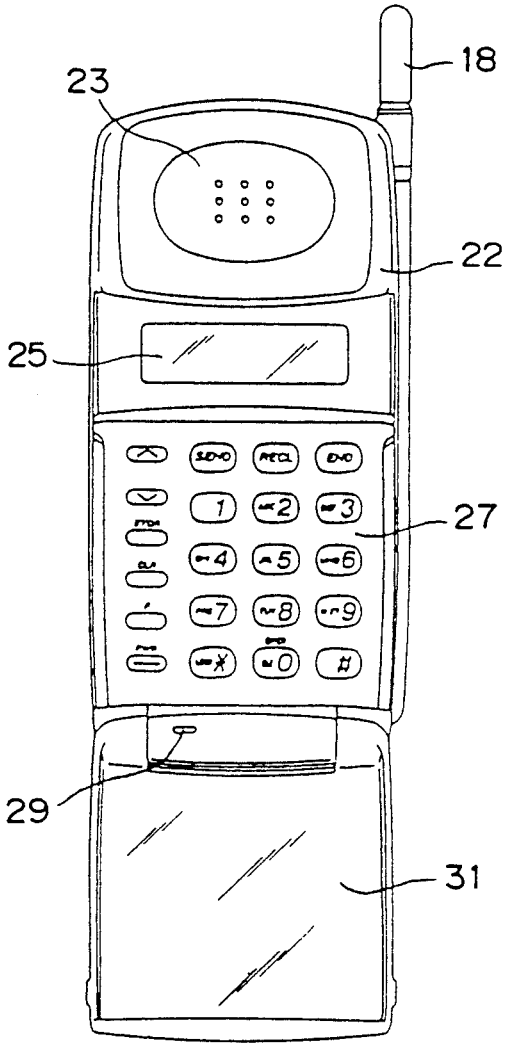
FIG. 3 is a plan view of the portable telephone shown in FIG. 3.
Figure 4:
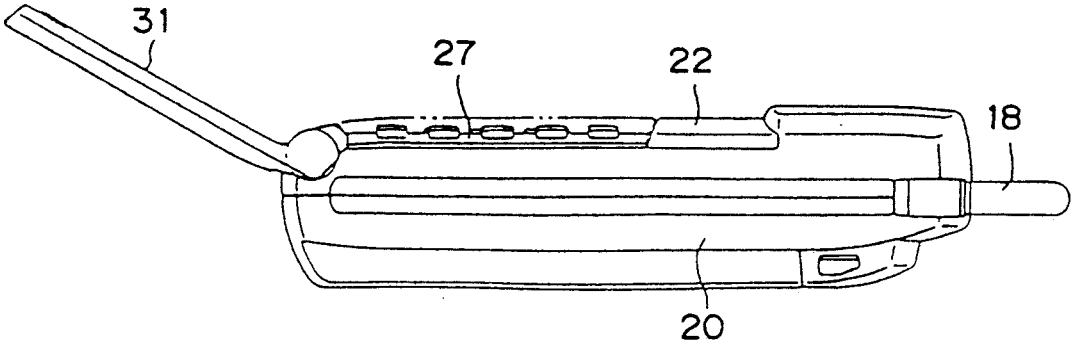
FIG. 4 is a side view thereof.

FIGS. 3 and 4 are a plan view and a side view respectively, showing the portable telephone shown in FIG. 2. In the upper end section of the front casing 22 is disposed a receiver 23 housing an earphone inside. Also in the middle part of the front casing 22 are provided a liquid crystal display 25 and a switch 27 having a dial function. The front casing 22 further has, in the left end of the lower end section, a transmitter 29 housing a microphone inside. In the vicinity of the lower end section of the front casing 22 is rotatably installed a cover 31, which functions to cover at least the switch section 27 when closed and to work as a reflection sound collector for the microphone housed in the transmitter 29 when opened.

Next, an embodiment of the rod antenna mounting mechanism according to the present invention will be explained in detail by referring to FIGS. 5 to 7. In the antenna mounting section of the front casing 22, a metallic insert 32 having internal threads is pressed. Since the threaded fixing part of the rod holder 6 is screwed into the insert 32, the rod antenna 4 is installed in the front casing 22 in such a manner that it may be pulled out of and pushed in the casing. At this time, the feeder plate 30 is pressed from the side thereof into contact with the pipe-like portion 10 of the rod holder 6 to thereby connect the rod antenna 4 to the radio circuit.

When the rod holder 6 has been removed from the front case 22 for the purpose of replacing the rod antenna assembly 2, the feeder plate 30 is disconnected from the pipe-like portion 10 of the rod holder 6, being deflected outwardly with a force of its own. When a new rod antenna assembly 2 is mounted, the feeder plate 30 is pushed toward the radio unit 24 by the pipe-like portion 10 of the rod holder 6 inserted, thus gaining a state of good contact between the feeder plate 30 and the pipe-like portion 10 of the rod holder. According to the present embodiment, as described above, it is possible to electrically connect the antenna element of the rod antenna assembly 2 easily and firmly to the radio circuit installed within the casing, and also possible to facilitate the replacement of the rod antenna assembly 2.

Figure 5:
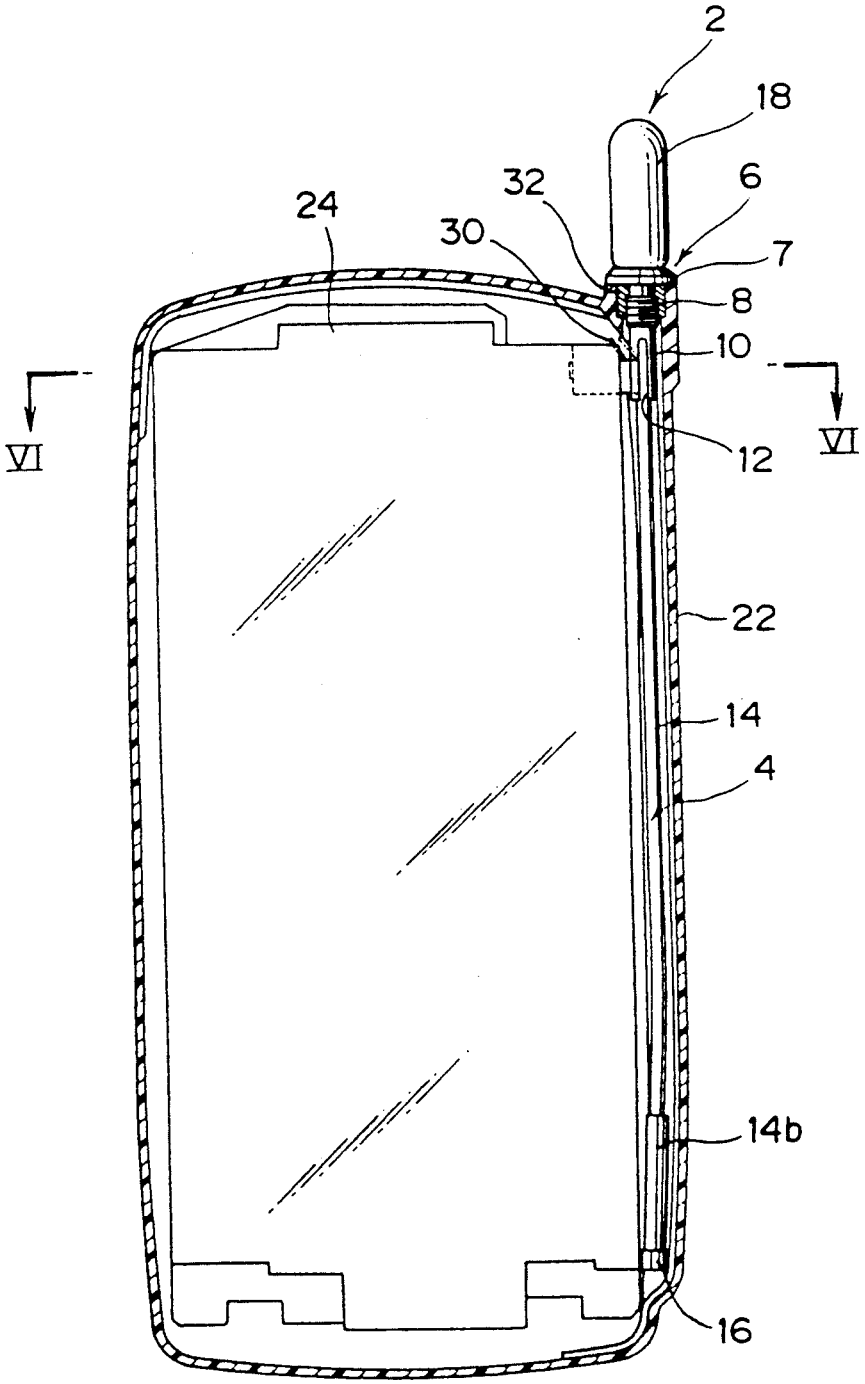
FIG. 5 is a sectional view of the portable telephone shown in FIG. 3.
Figure 6:
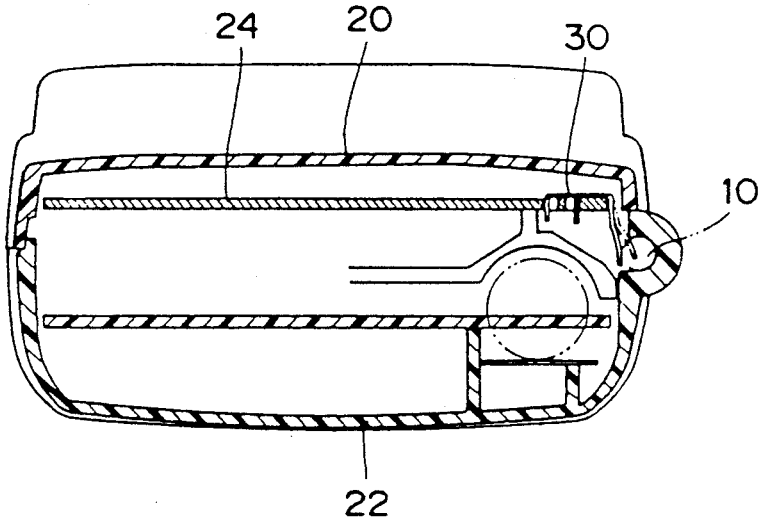
FIG. 6 is a sectional view taken along line VI—VI of FIG. 5.
Figure 7:
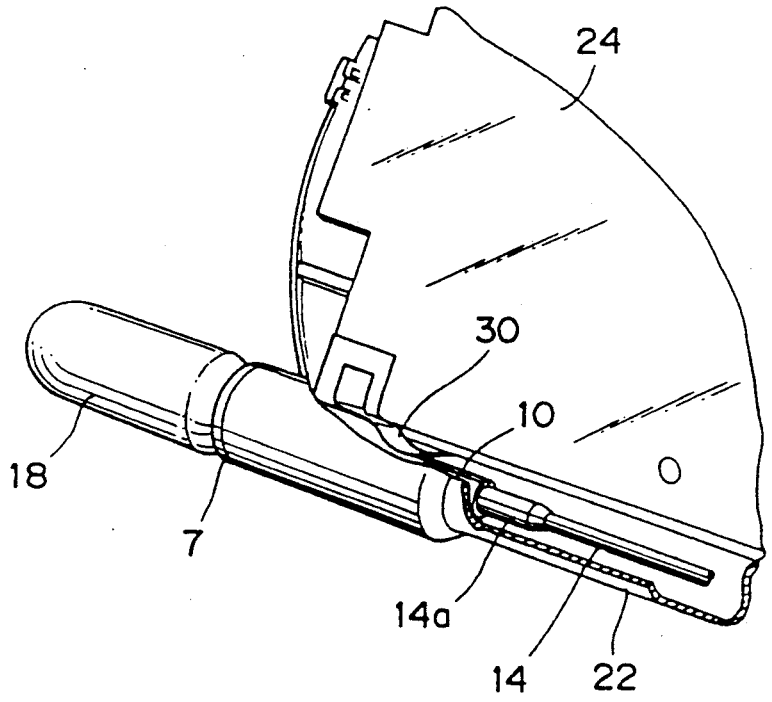
FIG. 7 is a partly broken perspective view of a rod antenna mounting section of the portable telephone.

In the state that the rod antenna 4 is installed within the casing as shown in FIG. 5 or 7, the first large-diameter rod section 14*a* of the rod antenna 4 contacts the pipe-like portion 10 of the rod holder 6, and the rod antenna 4 can be held as-stowed within the casing by a frictional force caused by the elastic deformation of the pipe-like portion 10. That is, the rod antenna 4 supported by the rod holder 6 will never be subjected to any change if it receives a force as great as an inertia force produced by acceleration likely to be applied during normal use of the portable telephone. At this time, when the first large-diameter rod section 14*a* is pressed into the pipe-like portion 10 of the rod holder 6, the first large-diameter rod section 14*a* will come into close contact with the pipe-like portion 10 of the rod holder 6 to provide electrical connection between them, and therefore it is possible to obtain a sufficient antenna gain for signal reception notwithstanding the stowage of the rod antenna 4 in the casing. At this time, since the rod antenna 4 is mounted in the vicinity of the side of the casing as shown in FIG. 5, the rod antenna is not electromagnetically shielded by a shield case 26 and the radio wave will never be interrupted.

On the other hand, when the rod antenna 4 is pulled out of the casing, the second large-diameter rod section 14*b* of the rod antenna 4 is pressed into the pipe-like portion 10 of the rod holder 6, thus insuring electrical connection between the antenna element and the feeder plate 30. At the same time, the rod antenna 4 is held in a pulled out position. The rod antenna 4 has a greater gain when pulled out of the casing than stowed in the casing, and therefore it is desirable to pull the rod antenna 4 out of the casing when talking. According to the rod antenna mounting mechanism of the present embodiment, the rod antenna is mounted such that it can be stowed in the casing and a substantial antenna gain for reception can be obtained even when the rod antenna 4 is stowed in the casing. It is, therefore, possible to make the portable telephone smaller in size.

Figure 8A:
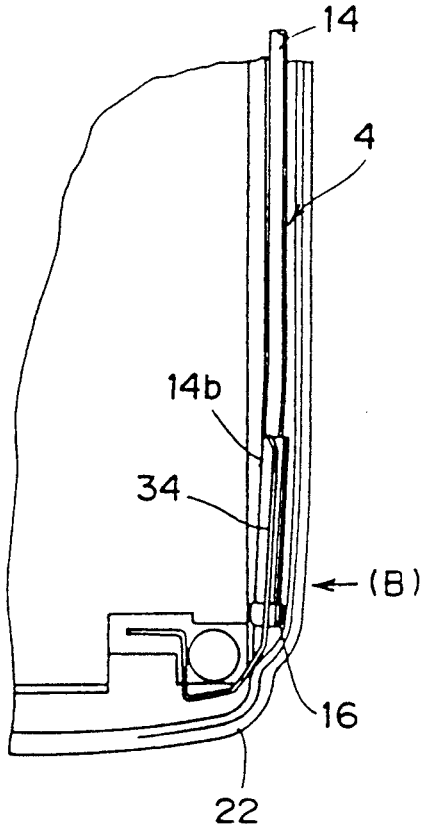
FIG. 8A is a perspective view of another embodiment of rod antenna mounting mechanism according to the present invention as viewed from the switch section side with the rod antenna housed in the casing.
Figure 8B:
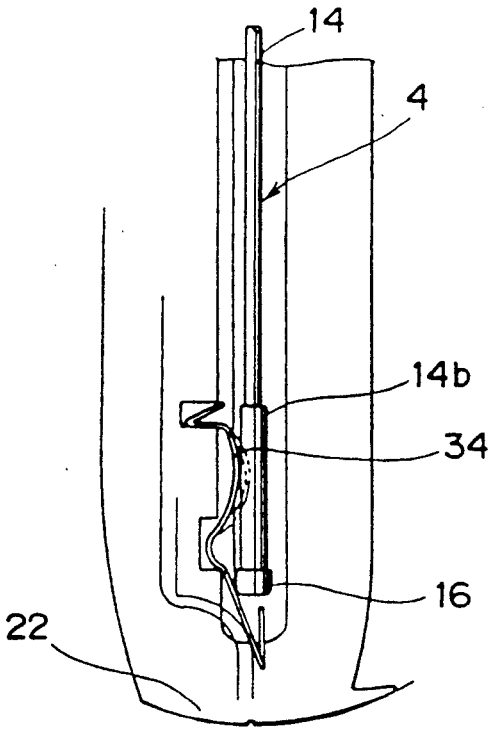
FIG. 8B is a perspective view taken along the arrow B in FIG. 8A.

Next, another embodiment of the rod antenna mounting mechanism according to the present invention will be explained with reference to FIGS. 8A and 8B. In this embodiment, an electrically neutral conductive member 34 is disposed within the casing so that the electrically neutral conductive member 34 contacts the second large-diameter rod section 14*b* when the rod antenna 4 is stowed in the casing. The conductive member 34 is fixedly installed within the front casing and will elastically deflect itself to press the rod antenna 4 into contact with the second large-diameter rod section 14*b* from the side thereof when the rod antenna 4 is stowed in the casing.

Figure 9A:
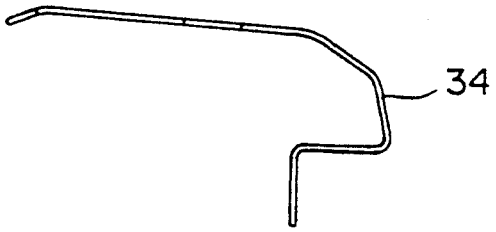
FIGS. 9A to 9C are front, plan and side views of the electrically conductive member shown in FIGS. 8A and 8B.
Figure 9C:
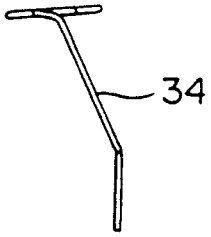
Figure 9B:
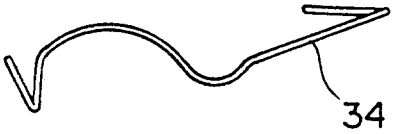

The shape of the conductive member 34 is shown in FIGS. 9A to 9C. The conductive member 34 has a complicated shape because it requires to be inserted in a space of complicated shape in the casing. In the present embodiment, the second large-diameter rod section 14*b* is designed to contact the electrically neutral conductive member 34 for the following reason. That is, generally in the state that the rod antenna is stowed within the casing, the part of the antenna above the feeder plate 30 is not long enough for the antenna waiting for a call. In this case, therefore, the portion of the antenna below the feeder plate 30 is used as an inner antenna waiting for a call in an attempt to positively provide the antenna as a whole with a necessary length corresponding to a conversation radio wavelength. According to the rod antenna mounting mechanism of the present embodiment, matching is effected for ideal stowage of the rod antenna in the casing, thus improving antenna gain during the reception of a call.

Figure 10:
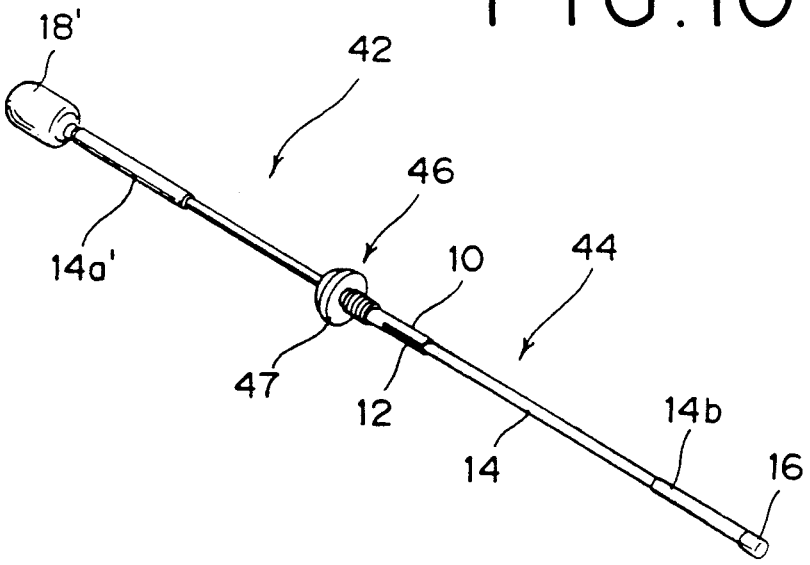
FIG. 10 is a perspective view of another embodiment of rod antenna assembly according to the present invention.

Next, a further embodiment of the rod antenna assembly according to the present invention will be explained by referring to FIG. 10. In the explanation of the rod antenna assembly of the present embodiment, the substantially same component members of the rod antenna assembly 2 as those shown in FIG. 1 are designated by the same reference numerals, and therefore will not be described for purpose of preventing redundancy. The rod antenna assembly 42 of the present embodiment is a static voltage-proof antenna. Differences of this rod antenna assembly 42 from the rod antenna assembly 2 shown in FIG. 1 lie in the points that the large-diameter head 47 of a rod holder 46 is produced of an insulating material such as a resin, that the first large-diameter rod section 14*a*′ is covered with an insulating material, and that the cap 18′ is formed short in length. The rod antenna assembly 42 is substantially the same in other components as the rod antenna assembly 2 shown in FIG. 1.

With the rod antenna assembly 42 of the present embodiment similarly mounted to the casing of the portable telephone and with the rod antenna 44 stowed in the casing, all exposed parts of the antenna assembly 42 are electrically insulated, thereby enabling prevention of inflow of the static electricity from the human body into the portable telephone.

Figure 11:
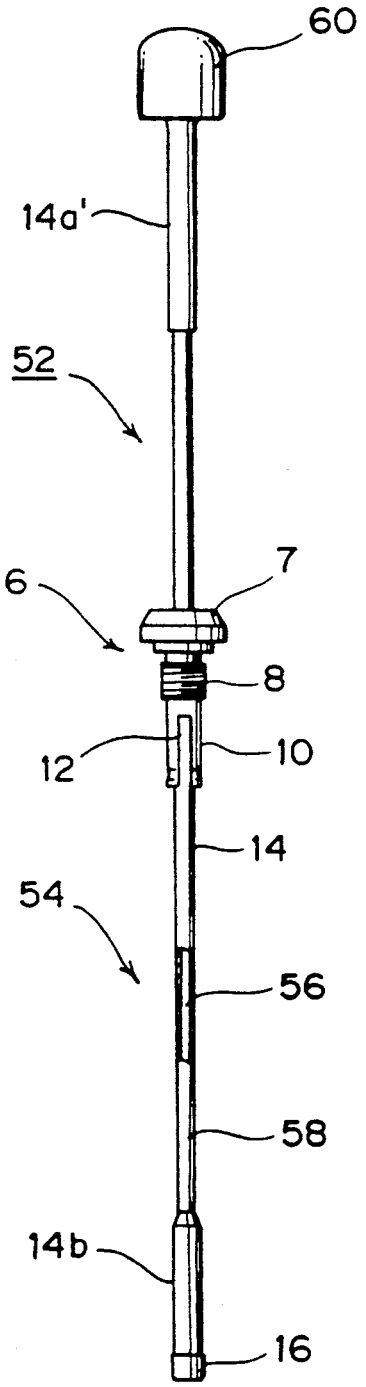
FIG. 11 is a front view of a further embodiment of the rod antenna assembly according to the present invention.

Next, a still further embodiment of the rod antenna assembly according to the present invention will be explained by referring to FIGS. 11 and 12. In the explanation of the present embodiment, substantially the same members as those of the rod antenna assembly 2 and 42 shown in FIGS. 1 and 10 are designated by the same reference numerals and not described herein in order to prevent redundancy. A rod antenna assembly 52 of the present embodiment is characterized by forming a short cap 60 and housing a coil-like antenna element in the cap. The small-diameter rod section 14 of the rod antenna 54 of the present embodiment is composed of an antenna element 56 covered with an insulating tube 58 as in the case of those of the first and second embodiments described above. The rod holder 6 is substantially identical to the rod holder shown in FIG. 1.

Figure 12:
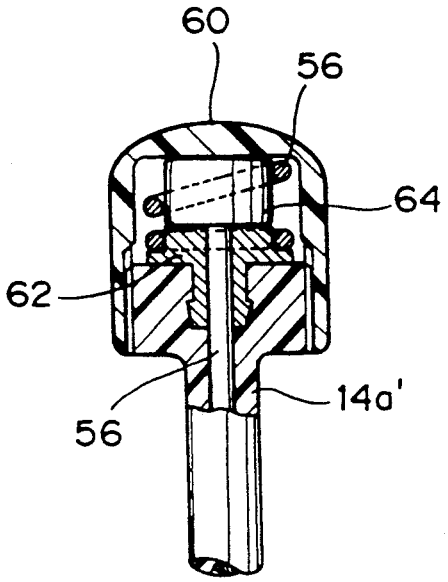
FIG. 12 is an enlarged sectional view of a cap section of the rod antenna assembly shown in FIG. 11.

In the enlarged sectional view of FIG. 12, a metal fitting 62 is pressed in an insulated large-diameter rod section 14*a*; a spacer 56 is contained in the cap 60; and an antenna element is wound in a form of coil around the spacer 56. It is, therefore, possible to provide a sufficient length of the antenna element by winding the antenna element 56 in a coil form in the cap. The first large-diameter rod section 14*a*′ is covered with an insulator similarly to the second embodiment shown in FIG. 10. When the antenna is stowed in the casing, the first large-diameter rod section 14*a*′ contacts the pipe-like portion 10 of the rod holder 6 allowing have electrically capacitive coupling an electrical capacitance coupling between the feeder plate 30 and the antenna element 56 inside, thus functioning as an antenna waiting for a call.

While the present invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A rod antenna mounting mechanism for extensibly and stowably mounting a rod antenna to a casing of a radio terminal equipment, said rod antenna including an extended small-diameter rod section, first and second large-diameter rod sections formed continuous to both ends of said small-diameter rod section, a cap formed at the end of said first large-diameter rod section, and a stopper formed at the end of said second large-diameter rod section, said rod antenna mounting mechanism comprising:

rod holder means slidably installed to said rod antenna for holding said rod antenna to said casing, said rod holder means having a pipe-like portion provided with a slit formed in a longitudinal direction to permit elastic expansion thereof and a large-diameter portion exposed out of said casing when said rod antenna is held in said casing, said large-diameter portion of said rod holder means being insulated;

an elastically deformable feeder plate connected to a radio circuit housed inside of the casing; and means for pressing said pipe-like portion of said rod holder means into contact with said feeder plate, said pipe-like portion and said second large-diameter rod section are electrically conductive, and said small-diameter rod section, said first large-diameter rod section and said cap are covered with an insulator, when said rod antenna is pushed into said casing and said first large diameter rod section contacts an inside surface of said pipe-like portion, said pipe-like portion elastically expands to receive said first large-diameter rod section press fitted into said pipe-like portion, and when said rod antenna is pulled out of said casing and said second large diameter rod section contacts the inside of said pipe-like portion, said pipe-like portion elastically expands to receive said second large-diameter rod section press fitted into said pipe-like portion.

2. The rod antenna mounting mechanism as claimed in claim 1, further comprising an electrically neutral conductive member disposed within said casing and wherein said second large-diameter rod section contacts said conductive member when said rod antenna is stowed in said casing.

3. The rod antenna mounting mechanism as claimed in claim 1, wherein said first and second large-diameter rod sections and said small-diameter rod section have an electrically conductive antenna element extended therein, and wherein said antenna element is extended into said cap wound in a form of coil.

* * * * *